US007243692B2

(12) United States Patent
Chang

(10) Patent No.: US 7,243,692 B2
(45) Date of Patent: Jul. 17, 2007

(54) CHISEL QUICKLY ADJUSTING AND POSITIONING DEVICE FOR A CHISELLING MACHINE

(75) Inventor: Richard Chang, Fang Yuan (TW)

(73) Assignee: Kingsand Machinery Ltd., Taichung Hsien (TW)

( * ) Notice: Subject to any disclaimer, the term of this patent is extended or adjusted under 35 U.S.C. 154(b) by 0 days.

(21) Appl. No.: 11/282,584

(22) Filed: Nov. 21, 2005

(65) Prior Publication Data

US 2007/0113926 A1 May 24, 2007

(51) Int. Cl.
*B27F 5/10* (2006.01)

(52) U.S. Cl. ..... 144/75; 144/74; 408/24; 408/30

(58) Field of Classification Search ..... 144/75, 144/76, 78, 74, 80; 408/22, 24, 30
See application file for complete search history.

(56) References Cited

U.S. PATENT DOCUMENTS 1,401,469 A * 12/1921 Hawkinson ..... 408/30
1,785,351 A * 12/1930 Knourek ..... 408/30
5,297,903 A * 3/1994 Hilton ..... 408/30
5,538,370 A * 7/1996 Glenn ..... 408/30
6,401,772 B1 * 6/2002 Beitl ..... 144/365

* cited by examiner

*Primary Examiner*—Shelley Self
(74) *Attorney, Agent, or Firm*—Troxell Law Office, PLLC

(57) ABSTRACT

A chisel quickly adjusting and positioning device for a chiseling machine includes a plurality of separating members for adjusting a gap between a sleeve and the bottom of a machine body, and a chisel unit composed of a chisel and a drill fitting lengthwise in the chisel. After the drill is fitted in the chisel and then clamped in a drill chuck, the chisel unit is fitted in the sleeve. Then the separating members can be pivotally moved in or out of the gap between the sleeve and the bottom of the machine body, and then the sleeve is pushed up so that a gap between the chisel blade and the tip of the drill may be formed for quickly adjusting and positioning the chisel unit with the machine body.

9 Claims, 5 Drawing Sheets

CHISEL QUICKLY ADJUSTING AND POSITIONING DEVICE FOR A CHISELLING MACHINE

BACKGROUND OF THE INVENTION

1. Field of the Invention

This invention relates to a chisel quickly adjusting and positioning device for a chiseling machine, particularly to one provided with a number of separating members for adjusting the gap between the tip of a drill and the chisel blade of a chisel of a chisel unit so as to quickly adjust and position the chisel unit in the chiseling machine.

2. Description of the Prior Art

In processing wood works, a chiseling machine is used for chiseling variously shaped holes, and a conventional chiseling machine generally uses a chisel unit composed of a chisel and a drill for performing the necessary work by drilling a hole at first by the drill, and then the chisel begins to chisel a square hole (for example) around the round hole made by the drill. In fixing the chisel unit on the chiseling machine, the chisel is at first fixed on the chiseling machine, and the gap between the chisel and the drill of the chisel unit is to be adjusted according to the practical necessity to enable the chisel unit to perform the chiseling work.

Nevertheless, to adjust the gap between the chisel and the drill of the chisel unit of the conventional chiseling machine is done by manual operation and eye measurement. Therefore, it may be not be done with accuracy, so to keep the drill stably is quite impossible without supporting the drill manually to tighten up a drill chuck.

SUMMARY OF THE INVENTION

The chisel quickly adjusting and positioning device for a chiseling machine in the invention is composed of a machine body and a chisel unit combined with the machine body. A drill chuck is provided in the machine body, and a sleeve hole is bored in the bottom of the machine body for a sleeve to fit therein. Then a handle is pivotally connected with the vertical wall of the bottom of the machine body for moving inward to push tight the sleeve or outward to loosen the sleeve. Further a number of separating members of a preset thickness are pivotally connected to the bottom of the machine body, possible to be pivotally moved in or out of the gap between the bottom of the machine body and the sleeve. The chisel unit is composed of a drill and a chisel, and the drill is fitted lengthwise in the chisel and has its upper end clamped immovable by the drill chuck, with the chisel having its upper tubular portion fitted in the sleeve. Then one or two of the separating members fitted in the gap between the bottom of the machine body and the sleeve is (or are) moved out, and the sleeve is pushed up to contact the bottom of the machine body. Then the handle is swung to push tightly against the upper tubular portion of the chisel in the sleeve so that the tip of the drill and the chisel blade may be separated by a gap, which is adjustable by moving out one or two of the separating members from the gap between the bottom of the machine body and the sleeve.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
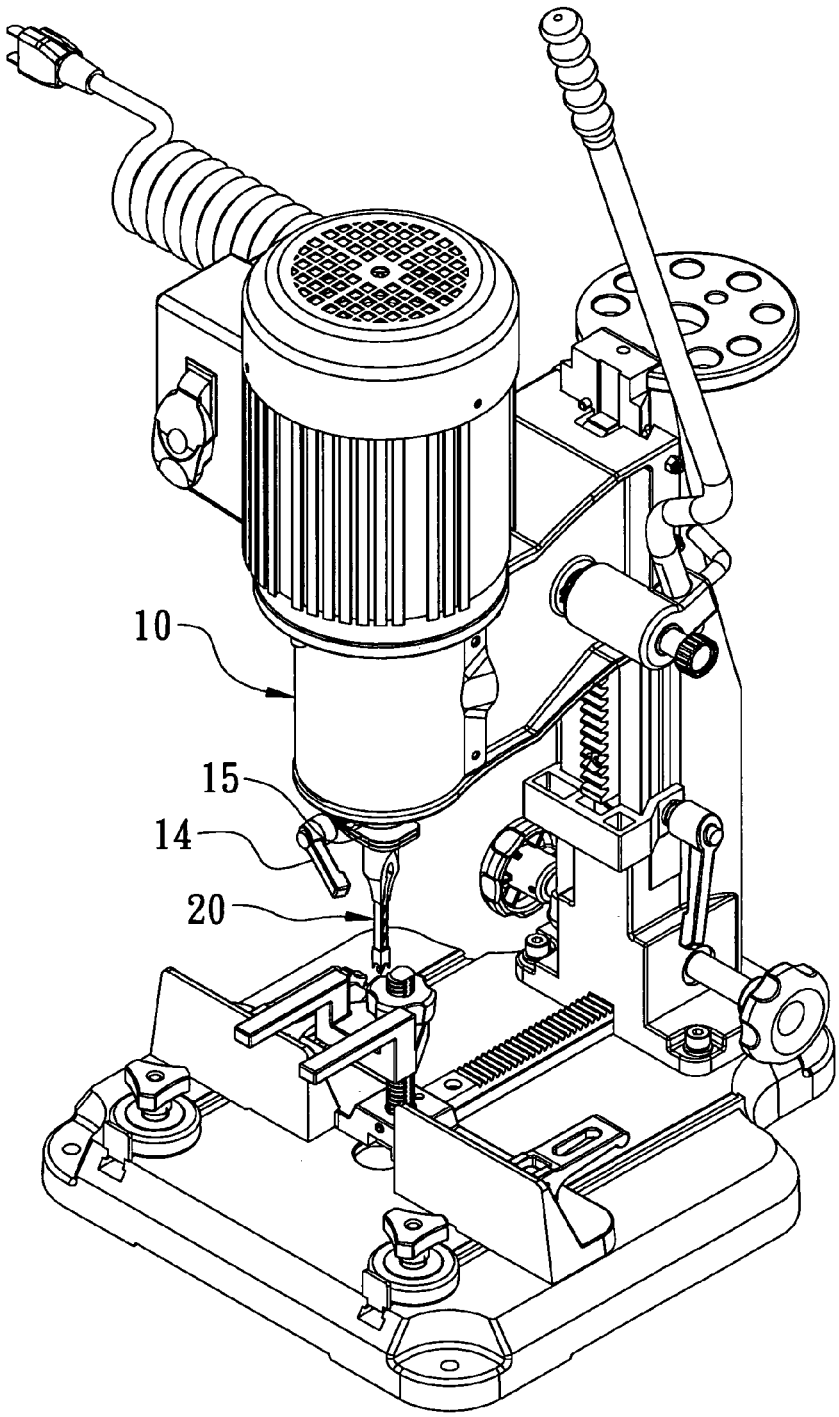
FIG. 1 is a perspective view of a chiseling machine with a chisel quickly adjusting and positioning device in the present invention.
Figure 2:
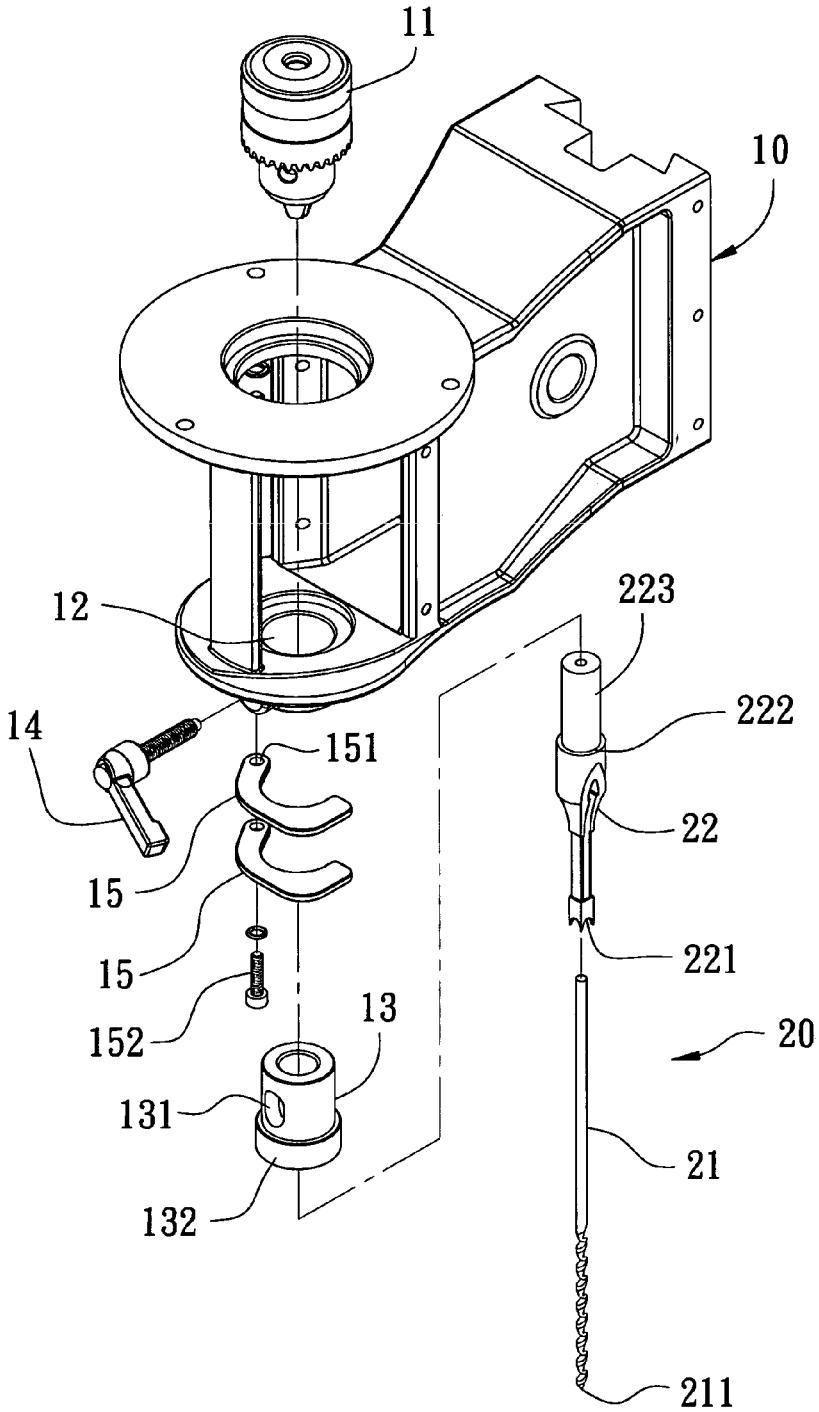
FIG. 2 is an exploded perspective view of the chisel quickly adjusting and positioning device for a chiseling machine in the present invention.

A chisel quickly adjusting and positioning device for a chiseling machine in the present invention, as shown in FIGS. 1 and 2, includes machine body 10, and a chisel unit 20 combined with the machine body 10.

The machine body 10 has a drill chuck 11 in its interior, and a sleeve hole 12 bored in the bottom and aligned to the drill chuck 11, a cylindrical sleeve 13 deposited in the sleeve hole 12 and having an oval hole 131 in an annular wall for a handle 14 to be screwed therein so as to push tightly against or loosen from the outer surface of the sleeve 13 in the sleeve hole 12. The cylindrical sleeve 13 further has an annular limiting member 132 formed in its lower portion, and two U-shaped separating members 15 are provided, made of plastic or metal and respectively having a hole 151 at one end for a bolt 152 to connect pivotally with the bottom of the machine body 10 so that the separating members can be moved in or out of a gap formed between the limiting member 132 and the bottom of the machine body 10, enabling the sleeve 13 adjusted in its position.

The chisel unit 20 is composed of a drill 21 and a chisel 22, and the drill 21 is lengthwise inserted down in the chisel 22 from above, with its tip 211 positioned limited within the chisel blade 221 of the chisel 22. The chisel 22 further has an annular intermediate recessed surface 222 and a sleeve member 223 formed upward on this recessed surface 222 to fit in the sleeve 13.

Figure 3:
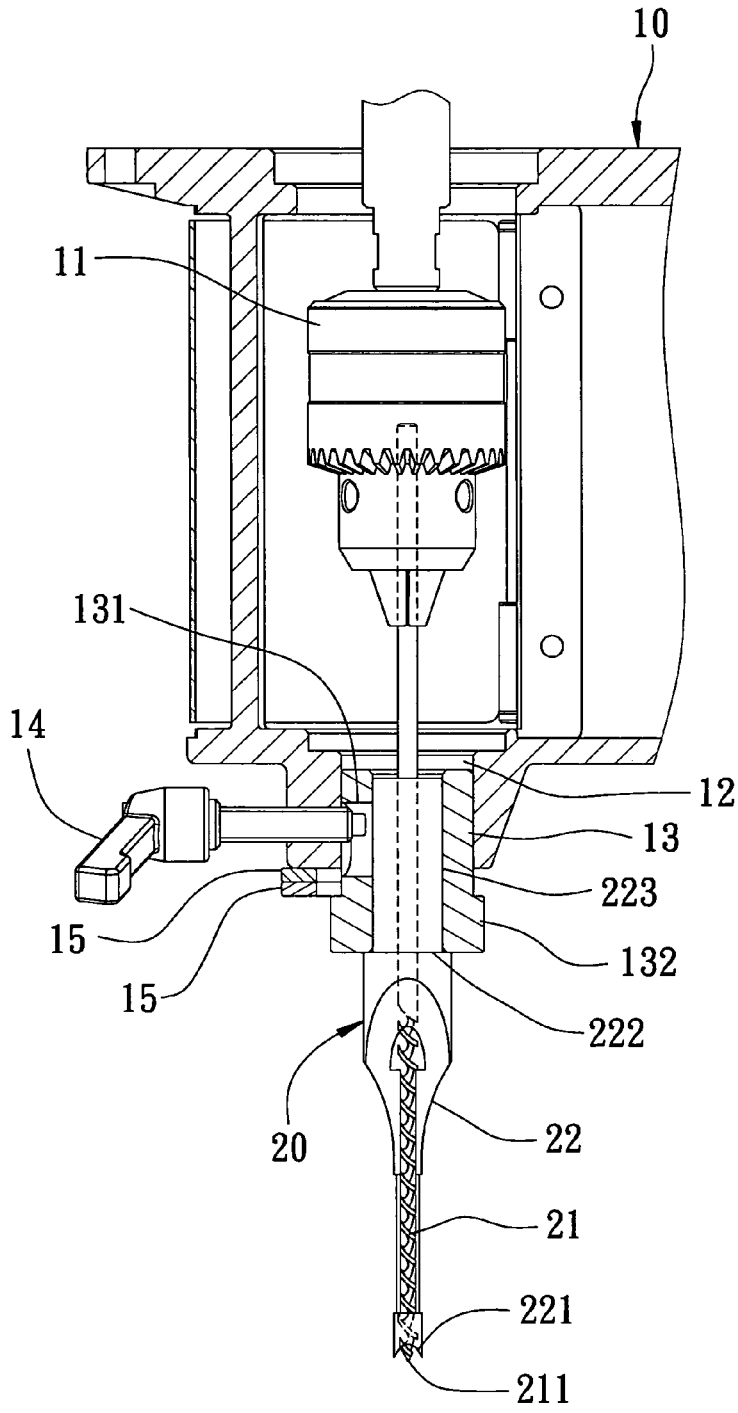
FIG. 3 is a cross-sectional view of the chisel quickly adjusting and positioning device fixed on a chiseling machine in the present invention.
Figure 4:
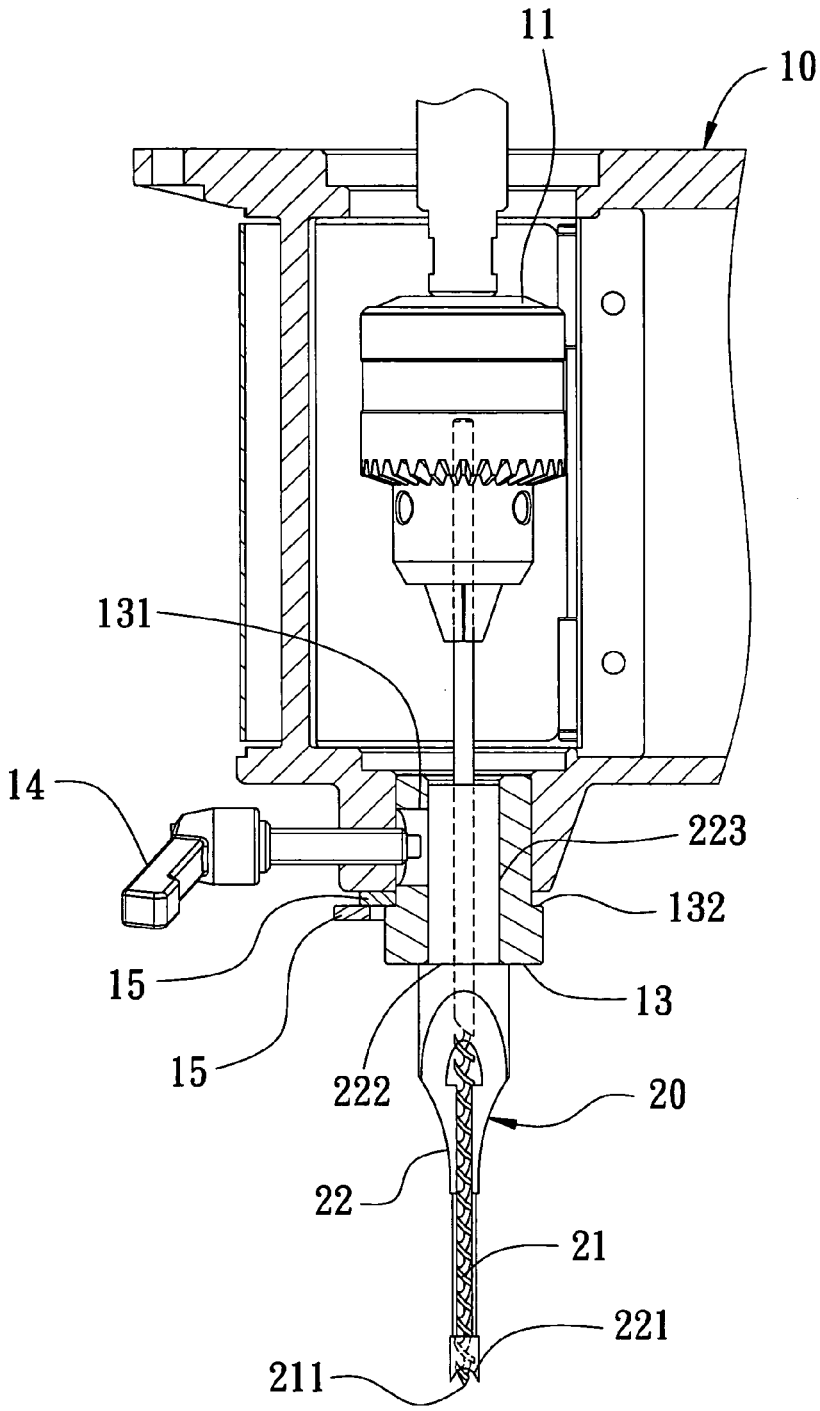
FIG. 4 is a cross-sectional view of separating members in the chisel quickly adjusting and positioning device in the present invention; and, FIG. 5 is a cross-sectional view of the separating members adjusted in the chisel quickly adjusting and positioning device in the present invention.
Figure 5:
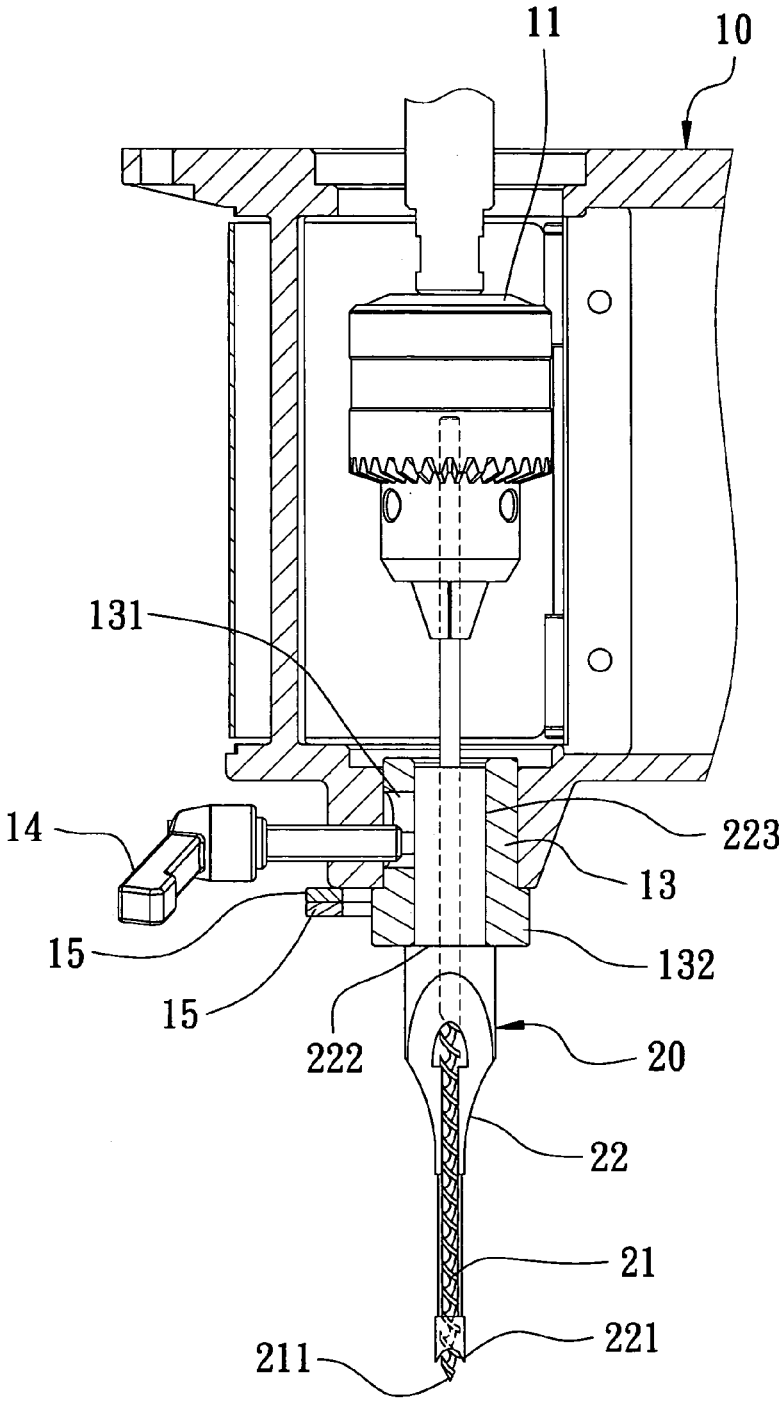

Next, in using, as shown in FIGS. 3 and 4, the chisel unit 20 is combined with the machine body 10, by screwing loose the handle 14 at first for the sleeve 13 to fall down. Then one of the separating members 15 is inserted between the annular limiting member 132 and the bottom of the machine body 10. Then the sleeve member 223 of the chisel 22 is inserted in the sleeve 13, letting the intermediate recessed surface 222 receiving and stopping the annular limiting member 132 of the sleeve 13. Next, the handle 14 is swung to move inward 110 to lock the sleeve member 223 immovable in the sleeve 13, and the drill 21 is inserted and clamped tight in the drill chuck 11. After that, as shown in FIG. 5, the handle 14 is swung to move outward to loosen the upper tubular portion 223 of the chisel 21, and the two separating members 15 are moved off the space between the bottom of the machine body 10 and the sleeve 13, raising the chisel 22 up and the annular recessed surface 222 push up the annular limiting member 132 at the same time, letting the annular limiting member 132 contact the bottom of the machine body 10. At this condition, the handle 14 is swung to move inward, pushing forcefully against the outer surface of the sleeve member 223, and at the same time the chisel 22 is lifted up to form a gap between the chisel blade 221 and the tip 211 of the drill 21, with the gap being equal to the thickness of one separating member 15. By the way, if the two separating members 15 are all inserted between the annular limiting member 132 and the bottom of the machine body 10, the gap between the tip of the drill 21 and the blade 221 of the chisel 22 will become larger.

The invention has the following advantages, as can be seen from the foresaid description.

1. The separating members can easily cause a preset gap between the chisel blade and the tip of the drill, and the number of the separating members can be adjusted to be move in or out of the space between the bottom of the machine body and the sleeve according to the needed gap by a woodwork.
2. The handle is operated to loosen or tighten the chisel for easily adjusting the separating members to install the chisel unit, very effectively for processing wooden works.

While the preferred embodiment of the invention has been described above, it will be recognized and understood that various modifications may be made therein and the appended claims are intended to cover all such modifications that may fall within the spirit and scope of the invention.

What is claimed is:

1. A chisel quickly adjusting and positioning device for a chiseling machine, said device comprising:

a machine body provided with a drill chuck in an interior thereof, a sleeve hole formed in a bottom of said machine body, a sleeve fitted in said sleeve hole and provided with an oval hole formed in an exterior wall of the sleeve and an annular limiting member formed on a lower portion of the sleeve, a handle screwed with said oval hole and having a front end extending in said sleeve hole;

a chisel unit fitting in said sleeve and composed of a drill and a chisel, said chisel provided with an intermediate annular recessed surface for receiving and stopping said annular limiting member of said sleeve and an tubular member formed in an upper portion, said upper tubular member fitting in said sleeve, said drill fitted lengthwise in said chisel and having its upper end clamped tightly in said drill chuck of said machine body; and, a predetermined number of separating members pivotally connected to said bottom of said machine body, said separating members respectively having a predetermined thickness, said separating members are selectively inserted between said annular limiting member of said sleeve and said bottom surface of said machine body adjustably forming a gap between a tip of said drill and said chisel blade.

2. The chisel quickly adjusting and positioning device for a chiseling machine as claimed in claim 1, wherein said separating members are respectively shaped as U, having a pivot hole at one end for a bolt to pass through for threadably engaging with the bottom of said machine body.

3. The chisel quickly adjusting and positioning device for a chiseling machine as claimed in claim 1, wherein at least one separating member is used for said separating members, pivotally connected to the bottom of said machine body.

4. The chisel quickly adjusting and positioning device for a chiseling machine as claimed in claim 1, wherein two separating members are used for said separating members, pivotally connected with said bottom of said machine body.

5. The chisel quickly adjusting and positioning device for a chiseling machine as claimed in claim 1, wherein said separating members are made of metal.

6. The chisel quickly adjusting and positioning device for a chiseling machine as claimed in claim 1, wherein said separating members are made of plastic.

7. The chisel quickly adjusting and positioning device for a chiseling machine as claimed in claim 2, wherein two separating members are used for said separating members, pivotally connected with said bottom of said machine body.

8. The chisel quickly adjusting and positioning device for a chiseling machine as claimed in claim 2, wherein said separating members are made of metal.

9. The chisel quickly adjusting and positioning device for a chiseling machine as claimed in claim 2, wherein said separating members are made of plastic.

* * * * *